United States Patent [19]

Borlinghaus

[11] 4,054,309

[45] Oct. 18, 1977

[54] CLOSURE LATCH

[75] Inventor: Hans J. Borlinghaus, Clarkston, Mich.

[73] Assignee: General Motors Corporation, Detroit, Mich.

[21] Appl. No.: 674,627

[22] Filed: Apr. 7, 1976

[51] Int. Cl.[2] ..... E05C 3/26

[52] U.S. Cl. ..... 292/216; 292/DIG. 14

[58] Field of Search ..... 292/216, DIG. 14, 280; 70/151 R

[56] References Cited

U.S. PATENT DOCUMENTS

| | | | |
|---|---|---|---|
| 3,010,749 | 11/1961 | Brissette et al. | 292/DIG. 14 |
| 3,184,936 | 5/1965 | Kirk | 70/151 |
| 3,917,330 | 11/1975 | Quantz | 292/216 |

*Primary Examiner*—Paul R. Gilliam
*Assistant Examiner*—Kenneth J. Dorner
*Attorney, Agent, or Firm*—Herbert Furman

[57] ABSTRACT

A closure latch includes a latch frame pivotally mounting a latch bolt and a cam member. A common torsion spring interconnects the bolt and cam member for biasing the bolt to unlatched position and biasing the cam member oppositely of the bolt. The cam member is normally located against the spring bias by engagement with the latch frame, and a cam surface of the cam member engages a leg of the bolt to maintain the bolt in latched position. When the cam member is rotated oppositely of the spring bias, the cam surface of the cam member moves past the leg of the bolt so that the spring rotates the bolt to unlatched position. The spring returns the cam member to its normal position in engagement with the latch frame and locates a shoulder of the cam member adjacent the leg of the bolt. When the bolt moves from unlatched to latched position, the leg of the bolt engages the shoulder of the cam member to rotate the cam member against the bias of the spring until the bolt leg has moved past the shoulder whereupon the spring returns the cam member to its normal position wherein it blocks movement of the bolt to unlatched position by engagement with the bolt leg.

2 Claims, 4 Drawing Figures

CLOSURE LATCH

This invention relates generally to closure latches and more particularly to closure latches of the type including a latch bolt movable between latched and unlatched positions and a cam member normally located in a blocking position for blocking movement of the bolt to unlatched position.

One feature of this invention is that the latch bolt and cam member are pivoted to a latch frame and are respectively biased to unlatched and blocking positions by common spring means. Another feature is that the bolt and cam member are respectively located in unlatched and blocking positions by engagement with the latch frame under the bias of the common spring means. A further feature is that movement of the bolt from unlatched to latched position engages the bolt with a shoulder of the cam member to move the cam member to an unblocking position and permit the bolt to move past the cam member shoulder so that the spring means can thereafter move the cam member to blocking position to retain the bolt in latched position.

These and other features of the invention will be readily apparent from the following specification and drawings wherein FIG. 1 is a sectional view of a vehicle body deck lid mounting a closure latch according to this invention to maintain the deck lid in closed position as shown;

Figure 1:
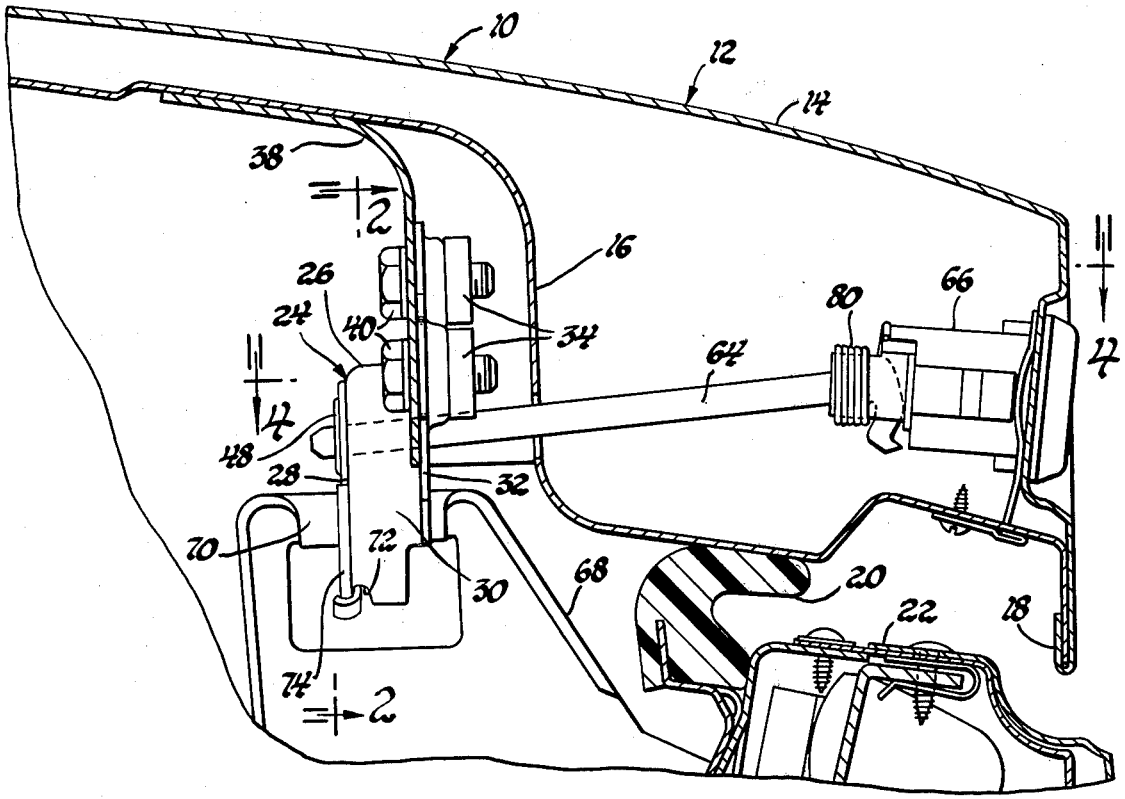

Referring now to FIG. 1, a vehicle body designated generally 10 includes a rear closure of deck lid 12. The deck lid 12 is conventional and includes an outer panel 14 and an inner panel 16 which are hem flanged to each other at 18 along their corresponding rear edges and are likewise hem flanged to each other along their corresponding side and forward edges, not shown. As is conventional, the deck lid is hinged to the body by suitable hinges, not shown, at the forward edge thereof for swinging movement between a closed position as shown and an open position, not shown. When the deck lid is in closed position, the inner panel 16 is sealed to the body by weatherstrip 20 mounted on conventional rear body structure 22.

Figure 2:
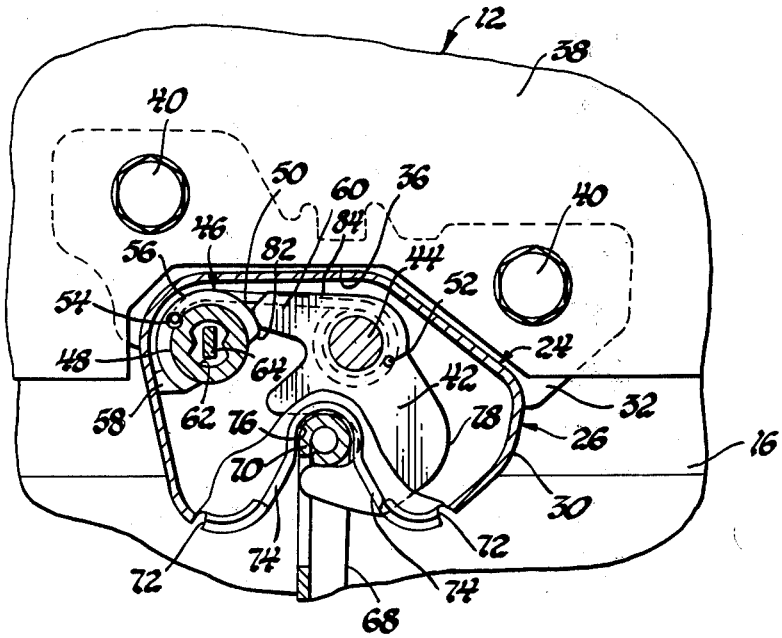
FIG. 2 is a view taken generally along the plane indicated by line 2—2 of FIG. 1.
Figure 3:
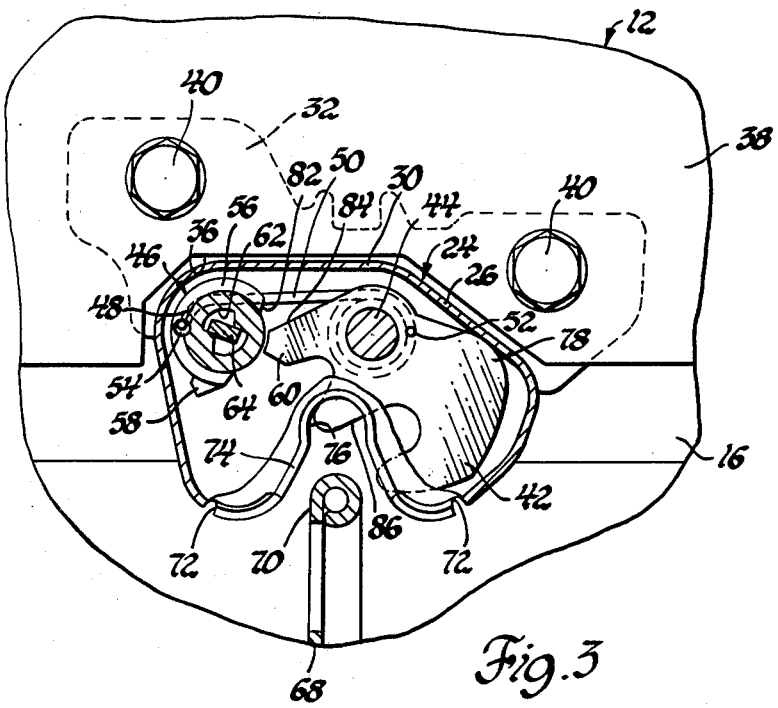
FIG. 3 is a view similar to FIG. 2 showing the cam member released from the bolt and the bolt in unlatched position.
Figure 4:
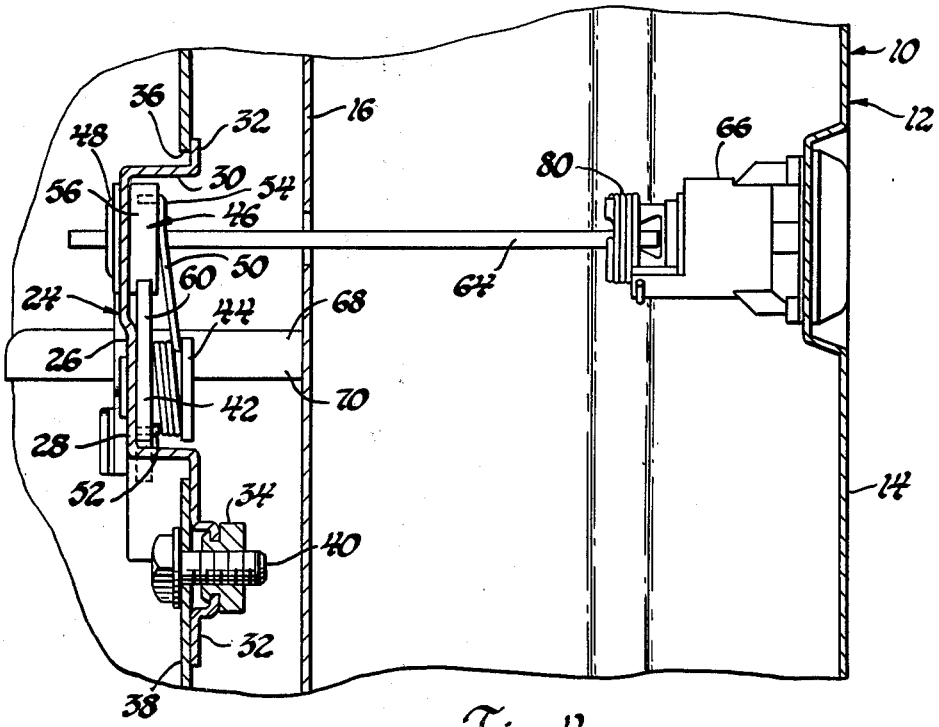
FIG. 4 is a sectional view taken generally along the plane indicated by line 4—4 of FIG. 1.

A closure latch according to this invention is designated generally 24. As shown in FIGS. 2 through 4, the closure latch includes a frame 26 having a base wall 28 and a semi-continuous integral lateral flange 30. A mounting flange 32 extends laterally from a portion of flange 30 and mounts slidable nuts 34, FIGS. 1 and 4. As shown in FIGS. 2 and 4, the frame 26 partially fits within an opening 36 of a mounting bracket 38 which depends from the deck lid inner panel 16, FIG. 1, in a conventional manner. The flange 32 abuts the rearward surface of bracket 38. A pair of bolts 40 extend through enlarged openings in the bracket 38 and are threaded into the nuts 34 as shown in FIG. 4 to thereby mount the closure latch 24 on the deck lid. The enlarged openings in the bracket 38 and the slidable nuts 34 provide for adjustment of the closure latch 24 relative to the deck lid.

A fork type bolt 42 is pivotally mounted on a shouldered stud 44 fixed to the base wall 28 of frame 26. A cam member 46 is pivotally secured to wall 28 by having a barrel portion 48 thereof rotatably fitted within an opening in the wall and being headed over a washer engaging the forward surface of the wall. A torsion spring 50 has one end wrapped around stud 44 and anchored at 52 to the bolt 42. The other end of the spring is anchored at 54 to a circular cam portion 56 of cam member 46 to thereby bias the bolt 42 counterclockwise as viewed in FIGS. 2 and 3 and bias the cam member 46 oppositely and clockwise as likewise viewed in these Figures. The cam member 46 is normally located in blocking position, as shown, by engagement of a lateral lug 58 thereof with flange 30. When the bolt is in latched position as shown in FIG. 2, a radiused leg 60 of the bolt is engaged with the surface of cam portion 56 to block movement of the bolt 42 to unlatched position. The radius of leg 60 is different than the radius of cam portion 56 to insure blocking of the movement of bolt 42 to unlatched position.

The barrel portion 48 of the cam member is provided with an hour glass type bore 62 which opens to a circular bore of cam portion 56. Both bores freely receive an operating member 64 of a conventional key cylinder 66. As can be seen in FIGS. 1 and 4, the key cylinder 66 is conventionally mounted on the outer panel 14 of the deck lid for key release of the closure latch as will be further described.

A conventional striker 68 is mounted on the rear body structure 22 and includes an integral upper rolled edge or striker bar 70 which is received between the fork legs of bolt 42 when the bolt is in latched position, FIG. 2, to thereby latch the deck lid 12 to the body structure 22. The lateral flange 30 of frame 26 is notched at 72 in two places and turned 180° upon itself as shown in FIGS 2 and 3 to provide a guide flange 74 guiding movement of the striker bar 70 into the throat portion 76 of frame 26.

When it is desired to open the deck lid 12, the operator inserts a suitably bitted key within the key cylinder 66 and rotates the member 64 counterclockwise as viewed in FIGS. 2 and 3. The member 64 thereupon picks up oppositely disposed shoulders of opening 62 as shown in FIG. 3 to rotate the cam member 46 in the same direction against the bias of spring 50 and move the cam portion 56 past the radiused leg 60 of bolt 42. When cam portion 56 clears leg 60, the spring 50 thereupon rotates the bolt 42 counterclockwise to unlatched position as shown in FIG. 3. The bolt is maintained in this position by engagement of a shoulder 78 of the bolt with the lateral flange 30 of frame 26. When the operator thereafter releases the key, a conventional torsion spring 80 of the lock cylinder returns the member 64 to its position shown in FIG. 2 and the spring 50 returns the cam member 46 to its position shown in FIG. 2 wherein the lug 58 again engages flange 30 as shown. When the cam member is in this position, a shoulder 82 of the cam portion 56 is disposed clockwise of its position shown in FIG. 3 and immediately adjacent an edge 84 of the radiused leg 60 of bolt 42.

When the deck lid is thereafter moved to a closed position, the striker bar 70 engages the throat 86 of bolt 42 and cams the bolt clockwise from its FIG. 3 position toward its FIG. 2 position. As the bolt moves clockwise, the edge 84 picks up the shoulder 82 and rotates the cam member 46 counterclockwise against the action of spring 50 until the bolt leg 60 has moved past shoulder 82. Spring 50 thereupon first rotates the cam member clockwise to its blocking position shown in FIG. 2, and then rotates the bolt 42 counterclockwise to engage leg 60 with the surface of cam portion 56 so that the bolt is blocked and maintained in latched position.

Thus this invention provides an improved closure latch.

It is claimed:

1. A vehicle body closure latch comprising, in combination, a latch frame, a cam member pivoted to the frame for movement between blocking and unblocking positions and including a blocking edge portion, a latch bolt pivoted to the frame for rotational movement between latched and unlatched positions and including a blocking leg having an edge portion, the cam member and bolt edge portions being contoured to generally mate with each other to block movement of the bolt to unlatched position independent of movement of the cam member and permit movement of the cam member to unblocking position independent of movement of the bolt, common spring means biasing the cam member to blocking position and biasing the bolt to unlatched position, means on the frame engageable by an abutment of the cam member to locate the cam member in blocking position and engage the cam member and bolt edge portions to maintain the bolt in latched position against the action of the spring means, operating means operable to rotate the cam member to unblocking position and move the edge portion thereof past the edge portion of the bolt while the bolt remains relatively stationary, the spring means thereafter rotating the bolt to unlatched position, means locating the bolt in unlatched position, cessation of operation of the operating means permitting the spring means to return the cam member to blocking position, engagement of the bolt with a striker moving the bolt from unlatched position past the latched position to engage the blocking leg of the bolt with a shoulder of the cam member and rotate the cam member toward unblocking position to permit the edge portion of the blocking leg of the bolt to move past the cam member shoulder, the spring means thereafter rotating the cam member to blocking position and rotating the bolt toward unlatched position to engage the edge portions of the bolt and cam member and maintain the bolt in latched position.

2. A vehicle body closure latch comprising, in combination, a latch frame having a peripheral wall portion, a cam member pivoted to the frame for movement between blocking and unblocking positions and including an arcuate edge portion generated around the cam member axis and terminating in a shoulder, a latch bolt pivoted to the frame for rotational movement between latched and unlatched positions and including a blocking leg having an arcuate edge portion generally mating with the cam member edge portion to block movement of the bolt to unlatched position independent of movement of the cam member and permit movement of the cam member to unblocking position independent of movement of the bolt, common spring means biasing the cam member to blocking position and biasing the bolt to unlatched position, an abutment of the cam member engaging the frame wall portion to locate the cam member in blocking position wherein the cam member and bolt edge portions engage and maintain the bolt in latched position against the action of the spring means, operating means operable to rotate the cam member to unblocking position and move the edge portion thereof past the edge portion of the bolt while the bolt remains relatively stationary, the spring means thereafter rotating the bolt to unlatched position, means locating the bolt in unlatched position, cessation of operation of the operating means permitting the spring means to return the cam member to blocking position, engagement of the bolt with a striker moving the bolt from unlatched position past the latched position to engage the blocking leg of the bolt with the cam member shoulder to rotate the cam member toward unblocking position and permit the edge portion of the blocking leg of the bolt to move past the cam member shoulder, the spring means thereafter rotating the cam member to blocking position and rotating the bolt toward unlatched position to engage the edge portions of the bolt and cam member and maintain the bolt in latched position.

* * * * *